United States Patent [19]

Caffoz et al.

[11] 4,252,134

[45] Feb. 24, 1981

[54] METHOD AND DEVICE FOR SPREADING OUT TOBACCO LEAVES AND FOR ENABLING THEM TO BE RETRIEVED, FLAT, AFTER HAVING BEEN SPREAD OUT

[75] Inventors: Robert Caffoz, Checy; Claude Juston, Saint-Jean-de-Braye; Claude Boutron, Olivet, all of France

[73] Assignee: Service d'Exploitation Industrielle des Tabacs et des Allumettes, France

[21] Appl. No.: 970,386

[22] Filed: Dec. 18, 1978

[30] Foreign Application Priority Data

Dec. 23, 1977 [FR] France ..... 77 38933

[51] Int. Cl.[3] ..... A24B 3/18

[52] U.S. Cl. ..... 131/147 A

[58] Field of Search ..... 131/147 R, 147 A, 133

[56] References Cited

U.S. PATENT DOCUMENTS

| | | | |
|---|---|---|---|
| 3,699,977 | 10/1972 | Hollenton | 131/147 R |
| 3,800,807 | 4/1974 | Hays et al. | 131/147 R |

*Primary Examiner*—J. MIllin

*Attorney, Agent, or Firm*—Jacobs & Jacobs

[57] ABSTRACT

A method for spreading out tobacco leaves and for enabling them to be retrieved, flat, after having been spread out, comprising:

placing each leaf on a support generally in the form of a deformable dihedron, the central vein of the leaf extending on the edge of said dihedron;

causing a flux of fluid to flow on either side of the edge, so that gravity conducts this fluid along the lines of greatest slope of said faces;

then deforming said support so as to return the spread out leaf to a flat position.

12 Claims, No Drawings

METHOD AND DEVICE FOR SPREADING OUT TOBACCO LEAVES AND FOR ENABLING THEM TO BE RETRIEVED, FLAT, AFTER HAVING BEEN SPREAD OUT

The present invention relates to a method and device for spreading out tobacco leaves, then for retrieving the spread out and flattened leaves, particularly with a view to using them as cigar wrappers.

Referring to the prior state of the art, it is observed that numerous methods have already been used to this end. An earlier French Pat. No. 76 26 326, filed by Applicants, mentions a certain number thereof, such as centrifugation, use of divergent mechanical means, the action of jets of air. However, most of these treatments have the drawback, if they are to be efficient, of being brutal, of handling the lamina of the leaves roughly and, consequently, of accentuating the originally tolerable imperfections thereof: small holes, incipient tears, etc.

This is why the above-mentioned French Application No. 76 26 326 claims the fact of placing the leaves in contact with a liquid fluid and of provoking a relative movement of the leaves and of the liquid fluid, said movement being effected in the sense of the spreading out of the leaves.

The present invention remains in line with the said French Application and, in this respect, therefore does not present the drawbacks inherent in the heretofore employed techniques. However, the present invention goes much further by meeting different objectives, of which the optimal conditions of production did not appear easily compatible: namely, regular conditions of spreading out and easy conditions for retrieving the leaves.

The method according to the invention provides placing a leaf on a deformable support which is given the general form of a dihedron, the central vein of the leaf extending on the top edge of the dihedron:

causing a flux of fluid to flow on either side of the top edge of the support, maintained in the form of a dihedron, gravity conducting this flux along the lines of greatest slope of the faces of this dihedron;

then deforming the support so that at least the zone of the support where the leaf rests is substantially flat at the moment of retrieving the spread out leaf.

Thus the method conciliates two facts: on the one hand, it is much easier to retrieve the spread out leaves when they are flat, with a view to immediate use or storage thereof; on the other hand, the spreading out is effected under better conditions when the two halves of the same leaf form a pronounced dihedral angle whose apex is constituted by the central vein of the leaf.

In fact, it is easy to observe that the folds of the leaves extend mainly parallel to the central vein of the leaf. The spreading forces must therefore be exerted from the central vein towards the periphery of the leaves, in a direction substantially perpendicular to said vein. If the leaf is then disposed flat, fluxes of fluid are then sent, in two opposite directions, parallel to the plane of the leaf, or at least with a very slight incidence. The efficiency of these fluxes thus being reduced, the rate of flow thereof must be increased; turbulences are then produced and the risks of damaging the leaves under the effect of two violent punctual actions appear again.

If, on the contrary, the leaf is placed on a support in the form of a dihedron, with its vein extending on the top edge of the dihedron and if said edge is maintained substantially horizontal, it suffices to direct a small flow of fluid towards the apex of the dihedron to exert a gentle and effective action. This action will be all the more gentle as the fluxes of fluid will meet the faces of the dihedron with a suitable incidence: there is then no spurting to be feared and the flow will tend to be laminary, promoting a regular spreading out of the parenchyma due to the uniformity of the pulls exerted. However, the action will be efficient as the fluxes of fluid will exactly follow the directions imparted by the faces of the dihedron, which will coincide with the direction in which the spreading out must be effected. This will be more particularly the case where the spreading out fluid is a liquid, for example water. In this case, the components of gravity on the lamina of the leaves, made heavier by being impregnated with the liquid, will act exactly to the desired extent, determined by the angle at the apex of the dihedron.

It already appears that it will be advantageous to facilitate the slide of the parenchyma on the faces of the dihedron. Thus said faces will be as smooth as possible. However, it has been found that this slide becomes perfect when a part of the fluid flows, preferably in the form of a thin film, between the lamina of the leaf to be spread out and the faces of the dihedron which bears it. This arrangement has unexpectedly made it possible to solve the difficulties of spreading out, which were heretofore virtually insaperable without manual intervention, which were produced when an edge of a leaf was considerably folded on itself and, in the extreme cases, when part of a half-leaf was folded, or even stuck on the adjacent part. It is therefore a primordial feature of the method of the invention that fluxes of fluid flow both on the faces of a support covered by a leaf and on the faces of the leaf which are not turned towards those of the support.

The invention also relates to a device for carrying out the above method. Such a device must present a zone of introduction to introduce the leaves to be spread out one by one, a zone where the leaves are spread out and a zone where the leaves spread out flat are retrieved, and means for supporting the leaves, which are deformable and movable between the zone of introduction and the zone where the leaves are retrieved, passing through the zone where said leaves are spread out, means for conducting, at least in the spreading out zone, fluxes of a fluid on at least one face of each leaf disposed on a support means, the surface of the support means in contact with a leaf being capable of being either inflected downwardly on either side of a central portion, particularly for spreading out the leaves, or flattened, particularly for the retrieval of the spread out leaves, shaping means being provided to give this surface in contact with the leaves the suitable form depending on the zone of the device through which the means for supporting the leaf in question passes.

The device according to the invention is characterized in that it comprises a support in the general form of a deformable dihedron, means for displacing said support in a determined path, means for conducting onto the faces of said support a flux of fluid directed from the edge to the ends of the faces of said support, and means for deforming said support.

The lateral parts of the support means (intended for receiving the lamina of the leaves) may, in order to render said means deformable, be pivoted about the edges of the central part of these same means (part carrying the midrib of the leaf). These three parts would then be discrete and assembled, for example, by thin pins. It has, however, appeared, that another type of construction was much more advantageous and the invention provides that the support comprises a series of pivoted elements, each being a dihedron of which the lateral faces are flat plates resting on a nondeformable base block and of which the edge on which the faces are pivoted is a rigid bar fixed to said block.

In one embodiment, the flat plates and the bar are in one piece and the pivoting of the plates on the bar is ensured by parallel notches.

This embodiment is both simple, economical and easy to maintain; moreover, the leaf-bearing face being smooth, there is no risk of damage of the leaves by pinching.

For the inclination of the lateral parts of the leaf-bearing elements to be effected precisely, it may be provided that the faces of the base block on which the lateral faces of each of the pivoted elements rest, themselves form a dihedron of which the edge is truncated to form a flat portion on which said bar is fixed.

To cause the fluid to flow on the face of a leaf-bearing element, even (and especially) when this face is covered with a leaf, perforations are provided, placing this face and the corresponding under-face in communication. These perforations constitute a part of the means for conducting the fluid toward the leaf-bearing faces.

In the case of the bearing elements being fixed on an undeformable base or another type of director element, part of said fluid conducting means passes through this base or any other bearing element so as to supply fluid, in the necessary zone, to the perforations placing the under-face and leaf-bearing face in communication.

It is possible to produce the leaf-supporting means in several different ways, for example in the form of individual assemblies, each intended to convey a leaf from the zone of introduction to the take-up or retrieval zone. In this case, the displacement of these assemblies may be effected either transversely with respect to the large dimension of their central part, or longitudinally, in the direction of this large dimension, therefore in that of the main vein of the tobacco leaves. It has been determined that, whatever the type of support means, this latter type of drive is the most favourable. Inter alia, it enables the central vein of the leaves to be maintained by a simple endless belt, of suitable section, which abuts, at least in the spreading out zone, on the central part of the support means. The central parts of a plurality of support means for successive leaves will therefore form an alignment in the direction of their displacement, at least between the zone of introduction of the leaves to be spread out and the take-up or retrieval zone of these leaves.

If this alignment is continuous, the operator who introduces the tobacco leaves one by one at the introduction station may effect this introduction at his own rhythm, without being obliged to respect the pitch between the central parts of successive support means. Whilst keeping his peace of mind, he supplies the device with the best possible yield as a function of the individual characteristics of the leaves.

All that precedes may be applied to the case of the bearing elements being constituted by an endless belt, inflected symmetrically about its longitudinal axis in the spreading out zone of the leaves and flattened in the take-up zone. However, in a preferred version, this belt will be replaced by successive plates, driven for example by an endless chain. These plates will be adjacent so as to ensure the continuity of the bearing means, but independent, this allowing the inflexion of two successive plates, at different angles. This arrangement allows the inflexion of the bearing means from the leaf introduction station, this facilitating the normal operation of the device and reducing its bulk. Furthermore, by choosing plates having a suitable rigidity, although the notches in their under-face allow them to be given the desired angulations, very simple shaping means may be used, such as ramps or other guide rails.

The assembly of these plates forms an endless belt; if it is desired to avoid giving the guide cylinders of this belt prohibitive dimensions, the length of the plates, taken in the direction of their displacement, therefore parallel to the notches, must be reduced. This dimension will thus be considerably smaller than the length of the tobacco leaves for wrapping cigars, taken in the direction of their central vein.

However, to flatten a tobacco leaf resting on several successive plates which together form the same dihedron, it is readily appreciated that it will be necessary to raise all the plates bearing the same half-leaf. To this end, means may be provided for connecting several successive plates upstream of the take-up zone of the spread out leaves, these connecting means being dependent on means for detecting the presence of the same leaf on said plates. These connecting means will preferably act on the free wings of the plates and will be such that the action of the shaping means on a leaf-bearing part of a plate at the point of take-up or retrieval of the leaves, will cause the simultaneous rise of all the homologous parts of the following plates connected thereto.

The invention will be more readily understood on reading the following description with reference to the accompanying drawings, in which:

FIG. 1 is a general view of the whole device.

FIG. 2 is an isometric projection of an element of the device.

FIG. 3 is a view of the locking system.

Referring now to the drawings, FIG. 1 shows the device subdivided into several zones:

- a zone A for the introduction of the tobacco leaves F, in which the leaves are placed on a support in the form of a dihedron, the midrib then being maintained on the apex of the dihedron.
- a zone B for spreading out the leaves F, in which the leaves, still on the support in the form of a dihedron, receive fluxes of water whose directions merge with gravity to spread out the leaves from the midrib to the edge of the parenchyma, the fluxes being applied on either side of the leaf.
- a take-up or retrieval zone C in which the support is returned from a dihedral shape to that of a horizontal plane to promote the retrieval of the spread out leaves by an assembly such as a suction belt.

The device is driven by an endless chain 1 with elongated links (FIG. 2). Each link 1 bears a rigid prismatic base 2 of which the section, in a plane perpendicular to the chain, is inscribed in an isosceles triangle, truncated at each of its apices, and of which the angle at the apex perpendicular to the bearing link is of the order of 60°. This angle which, as will be seen hereinafter, determines the maximum inflexion which the leaf supports may take, could, without the principles of construction and of functioning of the device being concerned, be larger or smaller by several tens of degrees; however, with an angle value of the order of that indicated hereinabove, it is known that the behaviour of the equipment and of the tobacco used is fully satisfactory.

Each base 2 supports a rectangular plate 4 of relatively rigid plastics material, fixed solely by its median part 5 on the flat portion 3, provided at the top of the base, by means of screws, as indicated in FIG. 1. Two notches 35 and 35' with rounded bottoms have been made along the whole of the underface of each plate 4 (i.e. the face turned towards the base). These notches correspond, once the plate 4 is mounted on the base 2, to one or the other of the two rectilinear edges which limit the flat portion 3 of the base 2. These notches determine on each plate two flat wings 6 and 7; a slight force exerted on the free end of one of these wings enables this wing to be folded towards the base until it rests on one of the inclined faces 8 or 9 thereof; forces exerted in the opposite direction may easily return the two wings 6 and 7 into the same plane, parallel to that of the flat portion 3.

The longitudinal clearance (i.e. in the direction of the chain) between the base blocks 2 which succeed one another on the chain, is small. The clearance which remains between two successive plates 4, once their wings have been returned into the same plane, for example in the horizontal plane in the vicinity of the take-up or retrieval station for the spread out leaves, is also very small.

On the horizontal upper side of the chain formed by the links 1, which constitutes the working side, the bases 2 are guided and supported by rails 10, 10'. In the horizontal upper wing of the rail 10 are provided regularly spaced apart water inlet conduits, opening through orifices 22. The spacing is such that the recess 13, milled in the underface of a base 2 which serves as slide guide for said latter on the rail 10, is always opposite at least one orifice 11, in the zone B for spreading out the leaves. A conduit 14, pierced in the mass of the base 2, enables the water thus collected by the recess 13 to be conducted into one and the other of the recesses 15, made on the two inclined faces 8 and 9 of the base. As the wings 6 and 7 are then applied to said inclined faces, this water passes through holes 12 made in these wings at an adequate distance from the notches 35, 35'. The pressure in the conduits opening at 11 is maintained at a level such that the water trickles over the wings 6 and 7 (whether or not they are covered with tobacco leaves) forming a film of substantially uniform thickness and of regular rate of flow.

At the base of each of the flanges 6 and 7, a locking system enables the successive plates 4 to be connected together in response to a member for detecting the presence of leaves (for example a photoelectric device).

This system is composed of a U-sectioned staple 17 mounted to pivot about an axis 16, so as to be able to cover the end of the following plate under the action of a stud 18 which is interposed, on the order of the member detecting the presence of leaves, on the path of said plates. This enables the different plates 4 bearing the same leaf to form only one support of which the movement is determined by that of the head plate.

Downstream of the take-up or retrieval zone C, a member, such as a stop, actuates each element 17 in the opposite direction from the preceding one, to individualise the plates before said latter pass on the guide cylinder (not shown) of the chain.

Ramps 20, disposed on either side of the chain 1 ensure guiding of the ends of the plates; their form is such that, upon passage from the spreading out zone B, where the wings of the plates form a dihedron, to the take-up or retrieval zone C, they raise the ends of the plates, until the wings 6 and 7 come in line with one another. After the leaves have been retrieved, these ramps serve to maintain the wings of the plates when returning towards the working side. Similarly, a rail 21 serves as support for the ends of the wings 6 and 7 during this part of the path up to their entrance in the introduction zone A in which it inflects so as to bring the wings 6 and 7 into position of dihedron.

At the outlet of the leaf introduction zone A and disposed above the chain 1, an endless belt 25 is provided to maintain the midrib of the leaf on the part 5 of the plate 4 fixed on the flat portion 3. This belt 25 accompanies the chain 1 over the whole spreading out zone B. Downstream of this zone, a suction conveyor 26 is disposed above the take-up or retrieval zone C to retrieve the leaves spread out on the plates 4 and to convey them for a subsequent treatment.

In the spreading out zone B, ramps 27 supplied with water under pressure are arranged to water the upper face of the plates 4 bearing the leaves, so as to form a flux which flows along the slope of the wings 6 and 7 of said plates 4.

The device functions as follows:

In the leaf introduction zone A, the wings 6 and 7 of the plates 4 rest on the faces 8, 9 of the base block 2 and form a dihedron on which the leaves F are disposed. The midrib is aligned on the central part 5, its projecting part preferably being located uppermost. The belt ensures the maintenance of the whole of the leaf by pressing on this central vein, the parenchyma remaining free on each side. Each leaf covers a plurality of successive plates 4 on the wings 6 and 7.

The movement of the chain 1 brings the leaves towards the spreading out zone B where they receive the fluxes of water:

on the one hand, in the form of a continuous flux issuing from the ramps 27, this pressing each half-leaf on the wings 6 and 7 of the plates and spreading over the exposed face of said leaves, following the slope of said wings;

on the other hand, in the form of a film of water coming from conduits 10, 14, which flows on the wings 6 and 7, between said latter and the non-exposed face of the leaves.

The combined action of these two fluxes on the support in dihedral form ensures the smoothing and spreading out of the parenchyma of the leaves.

A detector detecting the presence of the leaves provokes the interposition, on the path of the wings 6 and 7 of the first plate 4 in question, of the stud 18 which actuates, by rotating about 16, each staple 17 to cover the end of the following plate. The plates bearing the same leaf are thus connected to one another and form a single support.

At the outlet of the leaf spreading out zone B, the head plate 4, guided by the ramp 20, initiates the rise towards a horizontal plane taking with it the following plates 4.

In the take-up or retrieval zone C, the wings 6 and 7 of the plates 4 bearing the same leaf are returned in line with one another. The spread out leaf is perfectly flat and is retrieved by the suction conveyor 26.

The plates 4 are then unlocked by a stud which obliges the staples 17 to rotate about 16 to release the following plates. Said latter may thus easily rotate about the guide cylinders of the chain 1, the wings 6 and 7 being maintained in line with one another, on the one hand by the ramp 20, on the other hand by the rail 21. When they arrive upstream of the introduction zone A, the ramp 20 abruptly stops maintaining the wings 6 and 7 and the rail 21 initiates a descent taking them along until they take the shape of a dihedron which facilitates the introduction of the leaves.

It may happen that one or several successive plates 4 do not bear leaves. They behave, in this case, in the same way as the head plate of an assembly of locked plates, i.e. they follow, independently, the same kinematic path. The fractioning of the leaf conveyor into independent plates combines the following advantages: it offers enough flexibility to allow an endless belt to be produced, whilst ensuring for the individual plates a sufficient rigidity for the inclinations which they are given to be absolutely precise. The different arrangements adopted require, moreover, only a minimum service of the machine by the operator. This operator places the leaves on their means of transport without having to respect an imposed cadence. The leaf presence detector takes over the task of joining the successive plates bearing one leaf, so that said plates behave as a continuous support.

What is claim is:

1. A method for spreading out tobacco leaves which comprises, placing each leaf on a support having a central portion and a pair of downwardly disposed wings pivotably joined to said central portion so as to define a truncated dihedron, the midline of the leaf being aligned along said central portion, causing a flux of fluid to flow by gravity over said wings so as to spread said leaves, and thereafter deforming said support so as to bring said wings into substantially coplanar relationship with said central portion.

2. The method according to claim 1 wherein fluid is allowed to flow both on the wings of the support covered by the leaf and on the face of the leaf which is not in contact with the support.

3. A device for spreading out and retrieving a tobacco leaf comprising a support, said support comprising a central portion operable to receive the midline of said leaf and a pair of wings pivotably joined on either side of said central portion and operable to receive the remainder of said leaf, means for deforming said support from a first truncated dihedron configuration in which said wings are disposed downwardly to a second flat configuration in which said wings and central portion are substantially coplanar, and means for conducting a flux of fluid over both faces of said leaf when said support is in said first configuration.

4. The device according to claim 3 wherein said support is constructed of flexible material.

5. The device according to claim 3 wherein there is a plurality of support elements pivotedly connected to one another in an endless chain.

6. The device according to claim 5 wherein said wings are aligned with one another.

7. The device according to claim 5 wherein the length of each support block is shorter than the mean dimension of the tobacco leaves parallel to the main vein.

8. The device according to claim 5 including means for detecting the presence of a single leaf on adjacent supports, and means for moving all of such supports to their second flat configuration simultaneously.

9. The device according to claim 5 wherein each of said support elements includes a nondeformable prismatic base block and said central portion is a rigid bar fixed to said base block.

10. The device according to claim 9 wherein the faces of said base block on which rest the lateral faces of each of the pivoted elements themselves form a truncated dihedron.

11. The device according to claim 6 including conduits in the base block and communicating between a source of said fluid and the surface of said block, and aligned orifices in the wings.

12. The device according to claim 9 wherein said wings and said central portion are defined on an integral piece by parallel notches cut on the underside to permit deformable pivoting.

* * * * *